United States Patent [19]

Liguori

[11] 4,311,403

[45] Jan. 19, 1982

[54] BALL-POINT PEN DEVICE

[75] Inventor: Tom Liguori, Poway, Calif.

[73] Assignee: National Pen Corporation, San Diego, Calif.

[21] Appl. No.: 134,056

[22] Filed: Mar. 26, 1980

[51] Int. Cl.[3] ..... B43K 7/00

[52] U.S. Cl. ..... 401/209; 401/213

[58] Field of Search ..... 401/208, 217, 203

[56] References Cited

U.S. PATENT DOCUMENTS

| | | | |
|---|---|---|---|
| 2,708,903 | 5/1955 | Fehling | 401/209 X |
| 3,174,175 | 3/1965 | Frank | 401/213 |
| 4,077,726 | 3/1978 | Hechtle | 401/209 |
| 4,164,377 | 8/1979 | Lohrman et al. | 401/213 |

FOREIGN PATENT DOCUMENTS

| | | | |
|---|---|---|---|
| 495379 | 8/1953 | Canada | 401/209 |
| 2745608 | 4/1979 | Fed. Rep. of Germany | 401/209 |
| 526177 | 5/1955 | Italy | 401/209 |
| 530283 | 6/1955 | Italy | 401/209 |

*Primary Examiner*—Edward M. Coven

*Attorney, Agent, or Firm*—McAulay, Fields, Fisher, Goldstein & Nissen

[57] ABSTRACT

A ball-point pen has an outer housing containing an ink reservoir tube with a writing tip supported in a nose piece in the shape of a cone which is press-fitted thereon. The nose cone is provided with a rear extension having a cylindrical outer wall and an inner concentric cylindrical wall having a central through bore that receives the writing tip. The cylindrical walls define an annular space therebetween that has a bottom seat. The ink reservoir tube is provided with a central ink passage and the end of the tube is received in the annular space with the inner cylindrical wall of the nose piece received within the ink passage whereby the passage and the bore are in communication. The elements are sized so that the reservoir tube is press-fitted on the inner cylindrical wall of the nose piece and the outer cylindrical wall exerts a radially inwardly biasing force against the reservoir tube to maintain the reservoir tube tightly wedged against the inner cylindrical wall. The writing tip is force fitted into the front end of the nose piece, and the whole assembly force fitted into a suitable outer casing.

5 Claims, 3 Drawing Figures

BALL-POINT PEN DEVICE

BACKGROUND OF THE INVENTION

The present invention relates to a new ball-point pen construction, and more particularly to a ball-point pen construction which ensures leak-tight interconnections between the writing tip, nose cone and ink reservoir using simple force-fit assembly techniques.

Ball-point pens have, for many years, been popular writing implements. They combine the ease of use of pencils with the permanency of ink pens, their cost is low, and they are reliable.

The basic structure of most ball-point pens includes a housing having an ink reservoir with a writing tip connected thereto. Depending on the type of pen that is to be produced, that is the selling price of the finished product, the housing may take any of a large number of forms and be made of many different materials ranging from hard plastic to gold or platinum.

The present invention relates to the reservoir-writing tip portion of a ball-point pen. Contained within the reservoir tube is the ink supply. Ink is dispensed through a tip, normally including a rolling ball which applies the ink to paper or other material. The tip is usually in the form of a metal cylinder with a ball supported within a socket at the front end thereof. The rear end of the tip is open and must communicate with the reservoir in a leak-tight fashion. This is often accomplished using a nose piece which may be in the form of a cone. The particular type of arrangement over which the present invention is an improvement is one wherein the metal tip, nose cone, and reservoir tube are all forced-fitted together.

Many force-fitting schemes have been applied to assembling a leak-tight connection between the elements in a ball-point pen. Most prior devices suffer from premature failure due to leaking around the interconnection joints, or are expensive to machine and assemble.

For example, U.S. Pat. No. 3,100,477 to Ermel shows, in FIG. 4, a basic force-fit type of construction representative of the prior art devices. In Ermel, the writing tip and nose cone are combined as a single unit with the nose cone force-fitted into a reduced end portion of the ink reservoir. U.S. Pat. No. 4,077,807 to Kramer et al shows a variant of the Ermel tip wherein the rear portion of the nose cone has an increased diameter to fit into the ink reservoir. This makes it unnecessary to machine the front end of the reservoir to the narrower cross section as required by Ermel. Canadian Pat. No. 506,205 to Andrews; and Austrian Pat. No. 260,724, are two further examples of prior art showing the basic force-fit construction of Ermel or Kramer et al.

A slightly stronger connection between the writing tip/nose cone arrangement and the ink reservoir was accomplished by variations on the simple force-fit structure, as shown, for example, in U.S. Pat. No. 4,077,726 to Hechtle; Swedish Pat. No. 164,128 to Clausen; and French Pat. No. 1,157,099. The various devices shown in these patents use inter-engaging ledges or other structural features requiring special machining and assembly techniques.

These force-fitted constructions, while having the major advantages of economy, simplicity of design and ease of assembly, nonetheless suffered from the major disadvantage of leakage at the connection of the elements. Accordingly, other techniques have also been applied in an endeavor to form a leak-tight seal between the writing tip and the reservoir, including a heat sealing technique wherein an ink reservoir tube is inserted into the rear of a plastic nose tip and then heat sealed around the rim; and a technique wherein the various elements are threaded so that they can be screwed together, or example as shown in French Pat. No. 57,397.

The present invention has an object to provide a ball-point pen structure wherein the writing tip, nose cone and ink reservoir can be simply and inexpensively assembled, without the need for expensive machine techniques for producing the pen elements, to produce a leak-tight construction.

BRIEF DESCRIPTION OF THE INVENTION

Briefly, a preferred embodiment of the invention comprises a molded plastic nose tip or cone having a pair of concentric rearwardly extending cylindrical walls. Defined between the inner and outer of the rearwardly extending walls is an annular space wherein is received the end of the ink reservoir tube. Extending through the nose cone is a writing tip receiving conduit which receives and connects the writing tip with the ink reservoir.

To assemble the pen, the reservoir tube is pushed over the inner cylindrical wall of the nose cone in a press fit. The elements are sized so the outer wall of the nose cone will exert an inwardly directed force against the reservoir tube. Thus, the combined restraining force of the inner cylindrical wall of the nose cone, the press-fitted portion of the ink reservoir, and the outer wall of the nose cone, acts to effectively lock the elements in the pen for leak-tight operation thereof. The tip is similarly inserted into the conduit in a press-fit so the writing point is also secured in place.

DETAILED DESCRIPTION OF THE INVENTION

Figure 1:
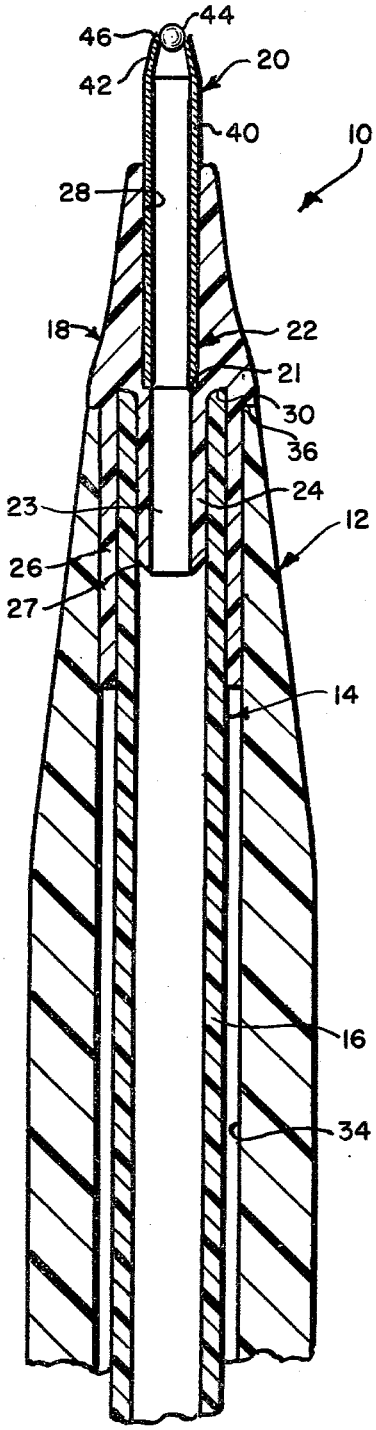
FIG. 1 is an enlarged sectional view of the press-fit interconnection of the various elements of the pen of the present invention.

A ball-point pen constructed according to the present invention is designated generally by the reference character 10 and comprises an outer casing 12 and an inner writing portion 14 contained therein. The outer casing 12 permits comfortable handling of the writing portion 14 and may have a decorative design or be made of precious metals.

The writing portion 14 comprises a cylindrical reservoir tube 16, a nose piece in the form of a cone 18 and a writing tip 20.

The nose cone 18 has defined therethrough a conduit 22 which receives the tip 20 therein in a press-fit and includes a passage 23 between the tip 20 and the reservoir tube 16 (FIG. 1), defined by inner cylindrical wall 24. A tip seat 21 limits the insertion of tip 20 into conduit 22 and helps to form a leak-tight seal.

Figure 2:
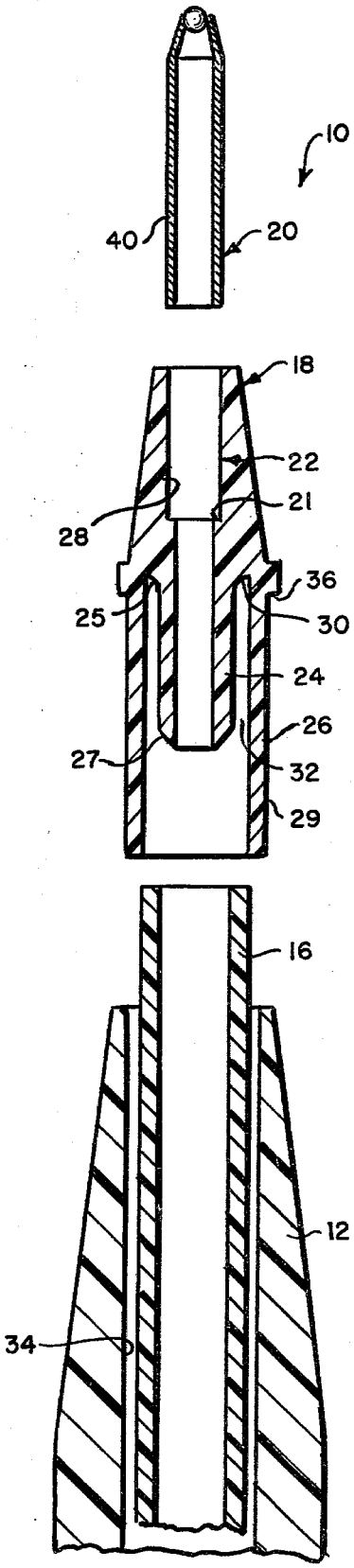
FIG. 2 is an exploded sectional view similar to FIG. 1 of the pen of the present invention.
Figure 3:
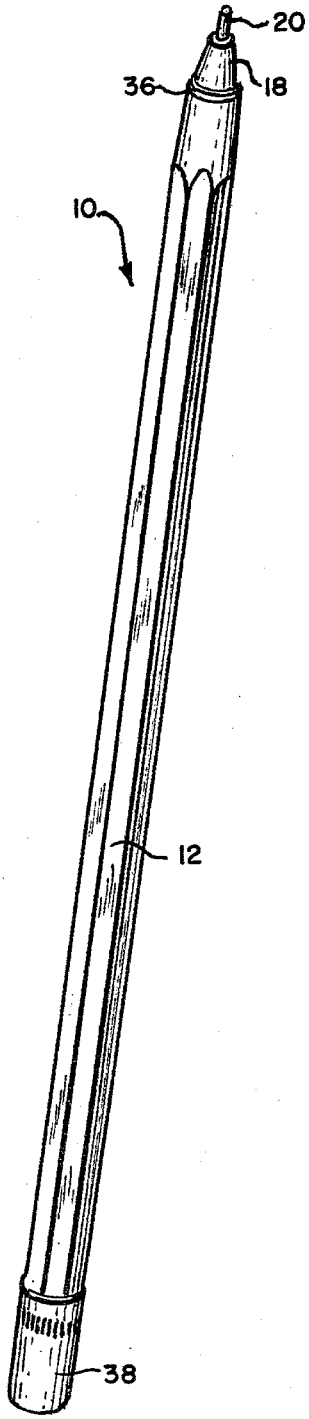
FIG. 3 is a perspective view of the assembled ball point pen fabricated according to the present invention.

The inner cylindrical wall 24 of nose cone 18 extends rearwardly from behind tip seat 21 and has an outer diameter slightly larger than the inner diameter of the reservior tube 16 which is closely received thereover for a force-fit engagement. In an actual construction, the outer diameter of wall 24 was 0.003 inches (0.008 cm) larger than the inner diameter of the tube 16. Typically, the reservoir tube 16 has an inner diameter of about 0.084 inches (0.213 cm). Thus, to accommodate this reservoir tube 16, an outside diameter for inner cylindrical wall 24, to provide a leak-tight closure, is about 0.087 inches (0.221 cm). It is also preferable to increase slightly the diameter of inner cylindrical wall 24, at the forward end 25 thereof in order to provide a tighter press fit with the reservoir tube 16. To facilitate sliding the reservoir tube into press-fit engagement with inner cylindrical wall 24, the rear portion 27 of inner cylindrical wall 24 is tapered to a cone shape as illustrated in FIGS. 1 and 2.

The nose cone 18 further includes an outer cylindrical wall 26 having an end portion 29 extending rearwardly beyond inner cylindrical wall 24 and having an inner diameter substantially the same as the outer diameter of the reservoir tube 16, typically 0.125 inches (0.318 cm). Thus, an annular space or cavity 32 is defined between outer and inner walls 24, 26 with a width slightly smaller than the width of the material from which the reservoir tube 16 is made, to clamp or force fit the reservoir tube 16 therein.

The end portion 29 of outer cylindrical wall 26 guides reservoir tube 16 against cone shaped end 27 of inner cylindrical wall 24. Forcing the reservoir tube 16 further into cavity 32 generates a wedging action between inner cylindrical wall 24 and the reservoir tube 16 to form a force fit closure therebetween. An increased diameter at forward end 25 may be provided to further enhance the wedging action, and therefore the tightness of the closure fit, as the reservoir tube 16 is pushed fully into cavity 32 to seat on the bottom 30, thereof.

This force-fit wedging action is still further enhanced by the close fit between the outer cylindrical wall 26 and the reservoir tube 16. Outer cylindrical wall 26 restrains the stretching of reservoir tube 16 that would otherwise occur as it is wedged over inner cylindrical wall 24. In other words, the reservoir tube 16 is received and tightly clamped between inner and outer cylindrical walls 24, 26.

The forward end of conduit 22 is in the form of a socket 28 which receives the cylindrical body member 40 of writing tip 20. The socket 28 has an inner diameter slightly smaller than the outer diameter of the writing tip body member 40 for essentially its full length to provide a force fit between the body member 40 of the writing tip 20 and the socket 28. Typically, the inner diameter of socket 28 is about 0.001 inches (0.003 cm) smaller than the outer diameter of the writing tip body to ensure a leak-tight force fit, although this may vary as required by the material used. As noted above, tip seat 21 limits the insertion of tip 20 into conduit 22 and seats the end of the tip 20.

The writing portion 14 is assembled, as described above, by force-fitting the writing tip 20, the nose cone 18 and the reservoir 16 together to form a unit. This writing portion 14 is supported in an outer casing 12 to protect and permit comfortable use of the writing portion 14. In addition, the casing 12 reinforces the clamping action of the outer cylindrical wall 26, as will be evident from the discussion below.

The outer casing 12 is formed with a longitudinal bore 34 receiving the reservoir tube 16 and outer cylindrical wall 26 therein. Preferably, the diameter of casing bore 34 is about equal to the outer diameter of outer cylindrical wall 26. Thus, casing 12 presses inwardly against the outer diameter of the outer cylindrical wall 26 to generate a force-fit relation. The radially inwardly directed biasing force that results from this force-fit relation not only holds the writing portion 14 in the outer casing 12, but also reinforces the outer cylindrical wall 26 against radial expansion to reinforce the clamping of reservoir 16 between the inner and outer cylindrical walls.

A flange 36 is provided on nose cone 18 to seat outer casing 12 and provide a finished look to the pen 10. An end cap 38 closes the rear of casing 12 and also provides a finished look to the pen 10. If desired, an eraser can be contained in the cap (not illustrated).

The structure described herein is easily formed using injection molding processes, for example those generally disclosed in U.S. Pat. No. 4,134,199 to Liguori, the inventor hereof. Resilient or memory possessing thermoplastic resins, as mentioned in U.S. Pat. No. 4,134,199, are suitable for forming the present invention nose cone.

A conventional ball point nib or tip 20 can be used to form the writing tip of the present invention. This can be a usual device having a cylindrical body member 40, which may be metal, having an ink transfer ball housing cavity with a rear ball seat 42 connected through the body member to an ink reservoir, and a front opening through which the ink transfer ball 44, which is rotatable, projects. The ink transfer ball 44 is retained in the housing cavity normally by an inwardly projecting annular lip 46 surrounding the front opening and having an inside diameter less than the diameter of the lip. The lip is generally integrally formed of a metal, such as brass, or other material including synthetic organic polymeric resins.

Any suitable housing or casing 12 can be used to receive the writing portion 14. That is, the outer surface of casing 12 may be decorated or otherwise finished, as desired.

The above is by way of illustration only, of the presently preferred embodiment, and is not intended to be limiting as to the scope of this invention.

What is claimed is:

1. A ball-point pen device of the type having an outer housing containing a writing portion; said writing portion comprising a cylindrical reservoir tube; a writing tip; a nose piece operable to secure said writing tip to said reservoir in leak-tight relation, said nose piece having defined therethrough a tip receiving conduit; the improvement comprising:

a straight sided inner cylindrical wall defining the rear portion of said tip receiving conduit, the outer diameter of said rear wall being sized to generate a force fit with the inner diameter of said reservoir;

a straight sided outer cylindrical wall disposed concentrically about said inner cylindrical wall and having an inner diameter substantially the same as the outer diameter of said reservoir;

said inner and outer circumferential walls defining therebetween an annular cavity having a width slightly smaller than the width of the walls of said reservoir tube;

said reservoir tube being seated in said annular cavity and force-fitted over said inner cylindrical wall to be clamped between said inner and outer cylindrical walls;

said conduit having a tip receiving socket with a reduced diameter portion sized to generate a force fit with said writing tip; said tip being received in said socket in force fit relation with said narrowed portion, thereby to hold said tip in said socket.

2. The pen device of claim 1 wherein said outer housing defines a bore therethrough wherein said writing portion is disposed, said bore being sized to generate a force fit between said outer housing and said outer cylindrical wall, to hold said writing portion and to generate inwardly directed bearing forces against said outer cylindrical wall.

3. The pen device of claim 1 or 2 wherein the outer diameter of said inner cylindrical wall is about 0.003 inches (0.008 cm) greater than the inner diameter of said reservoir.

4. The pen device of claim 2 wherein said writing portion further comprises a flange member near the front end thereof, to position said writing portion in said housing.

5. The pen device of claim 1 wherein said tip receiving socket further comprises a tip seat to seat said tip and restrain its further insertion into said tip receiving socket, when said tip has been inserted a predetermined distance into said tip receiving socket.

* * * * *